US005490829A

United States Patent [19]

Beord et al.

[11] Patent Number: 5,490,829

[45] Date of Patent: Feb. 13, 1996

[54] DOCUMENT FOLDING MACHINE EMPLOYING A FLAP

[75] Inventors: Jacques Beord, Conches; Herv´´ Baumann, Paris, both of France

[73] Assignee: Secap, Boulogne Billancourt, France

[21] Appl. No.: 237,345

[22] Filed: May 3, 1994

[30] Foreign Application Priority Data

May 3, 1993 [FR] France ..... 93 05244

[51] Int. Cl.[6] ..... B65H 45/18; B65H 37/06; B65H 45/16; B42C 1/00

[52] U.S. Cl. ..... 493/419; 493/436

[58] Field of Search ..... 493/419, 420, 493/436, 437, 442, 443, 454

[56] References Cited

U.S. PATENT DOCUMENTS

| | | | |
|---|---|---|---|
| 2,997,295 | 8/1961 | Beck | 493/420 |
| 4,202,621 | 4/1980 | Yoshimura et al. | 355/14 R |
| 4,403,981 | 8/1983 | Wuthrich | 493/442 |
| 4,484,905 | 11/1984 | Ashburner | 493/419 |
| 4,985,013 | 1/1991 | van der Werff et al. | 493/437 |
| 4,997,175 | 3/1991 | Hashida et al. | 493/419 |
| 5,129,876 | 7/1992 | Brabant et al. | 493/419 |

FOREIGN PATENT DOCUMENTS

| | | |
|---|---|---|
| 0421547A1 | 4/1991 | European Pat. Off. . |
| 0485797A1 | 5/1992 | European Pat. Off. . |
| 2757182 | 6/1979 | Germany . |
| 60-223766 | 11/1985 | Japan . |
| 63-001675 | 1/1988 | Japan . |
| 63-134471 | 6/1988 | Japan . |
| 1394480 | 4/1973 | United Kingdom . |
| WO84/00350 | 2/1984 | WIPO . |

*Primary Examiner*—Bruce M. Kisliuk
*Assistant Examiner*—Christopher W. Day
*Attorney, Agent, or Firm*—Hoffmann & Baron

[57] ABSTRACT

This folding machine comprises two input rollers (5) for feeding the paper, two output rollers (18, 18') for discharging the paper controlling the movement, a paper guide (8) pivotally mounted between the input rollers (5) and the output rollers, capable of assuming a first and a second position and comprising a press roller (14, 14'), the assembly being controlled to permit forming loops and folds of the paper.

6 Claims, 14 Drawing Sheets

SECTION A A

DOCUMENT FOLDING MACHINE EMPLOYING A FLAP

The present invention relates to a folding machine for folding documents to be put into an envelope. It is in particular intended for office folding machines.

At the present time, the most common folding system in this type of machine is the so-called pocket system, known for example from the document EP-A-0 485 797.

The pocket folding machines fold a document in two or three.

They employ two pockets, generally arranged as a V, coupled to a folding unit formed by four rollers. This technology employing a large number of mechanical parts results in on one hand a large overall size and on the other hand poor accessibility when the paper becomes jammed.

On this type of folding machine, the document strikes against a stop located in each of the pockets and is then taken up by the folding rollers. The impact of the paper against the stops produces a high sound level.

The modification of the length of the folds is achieved by the adjustment of each pocket stop. The operator must intervene manually to effect these adjustments.

Folding machines are also known from the document JP-A-631 676 or GB-A-1 394 480 which comprise between input rollers and output rollers a guide which is movable between two positions and brings the paper alternately in front of a first or a second pair of output rollers, whereby the folds of the document are formed. However, these machines, owing to the large number of rollers and the complexity of the related controls thereof, again present constructional and maintenance problems.

A folding machine is known from the document U.S. Pat. No. 4,997,175 which is of the type comprising two input paper feeding rollers controlled by first control means, two output paper discharging rollers controlled by second control means, a paper guide pivotally disposed between the input rollers and the output rollers and capable of assuming a first and a second position, the guide in its first position directing the paper from the input rollers to the output rollers, and, in its second position, directing the paper from the input rollers to a region spaced away from the output rollers, a press roller which is capable, when the guide is in the first position, of being applied against one of the two rollers, an electronic control unit for synchronizing and controlling the pivoting of the guide and the movement of the input and output rollers.

By an appropriate arrangement of the movements of the rollers it is possible to effect a fold. However, in the same way as the folding machines described hereinbefore, this machine requires complex driving devices (in particular because some of the rollers must be rotatable in both directions) and results in a bulky machine. The same is true of the folding machine disclosed in the document EP-A-0 421 547, above all as soon as it concerns effecting no longer a single fold but two folds.

The object of the invention is to avoid the foregoing drawbacks and to propose a machine which is of simple and robust design, on the whole more compact, and is capable of effecting just as simply two folds or a single fold with a reduced total number of mechanical parts.

According to the invention, the folding machine is of the general type described hereinbefore known from U.S. Pat. No. 4,997,175 and is characterized in that the pivotal papor guide comprises, connected to move therewith, said press roller so that, when the guide is in the first position, the press roller comes to be applied against one of the two output rollers, and, when the guide is in the second position, the press roller is disengaged from said roller, and the first and second control means and the control unit are coordinated for carrying out the following steps:

c) passage of the guide to the second position, d) forward driving of the input rollers for advancing the paper through the guide by a predetermined first length, the front of the paper being disengaged from the output rollers, e) passage of the guide to the first position, so that the press roller presses the paper against one of the two output rollers, f) forward driving of the input rollers for advancing the paper through the guide a second predetermined length and forming the initial portion of a loop directed toward the output rollers, g) forward driving of the output rollers for seizing the initial portion of the loop and driving the remainder of the paper.

These means enable a fold to be made on a document.

It will be obvious that a roller designates both continuous rollers and discontinuous rollers or assemblies of small rollers.

These means are advantageously completed so as to permit effecting a second fold, in the opposite direction. For this purpose, the first and second control means and the control unit are coordinated to carry out, before the steps c) to g), the following steps:

a) passage of the guide to the first position, b) forward driving of the input rollers for advancing the paper through the guide by a third sufficient predetermined length so that the front edge of the paper is seized in the output rollers, the subsequent forward driving of the input rollers in step d) having for effect to form an initial portion of a loop moving away from the input and output rollers.

This initial portion of the loop is rolled between the output rollers at the same time as the initial portion of the loop formed in step f).

Advantageously, there are provided means for detecting the paper, for example a cell detecting the passage of the front and rear edge of a document. This cell is preferably placed on the guide.

Other features and advantages of the present invention will appear from the following description of an embodiment illustrated in the accompanying drawings. In these drawings.

Figure 1:
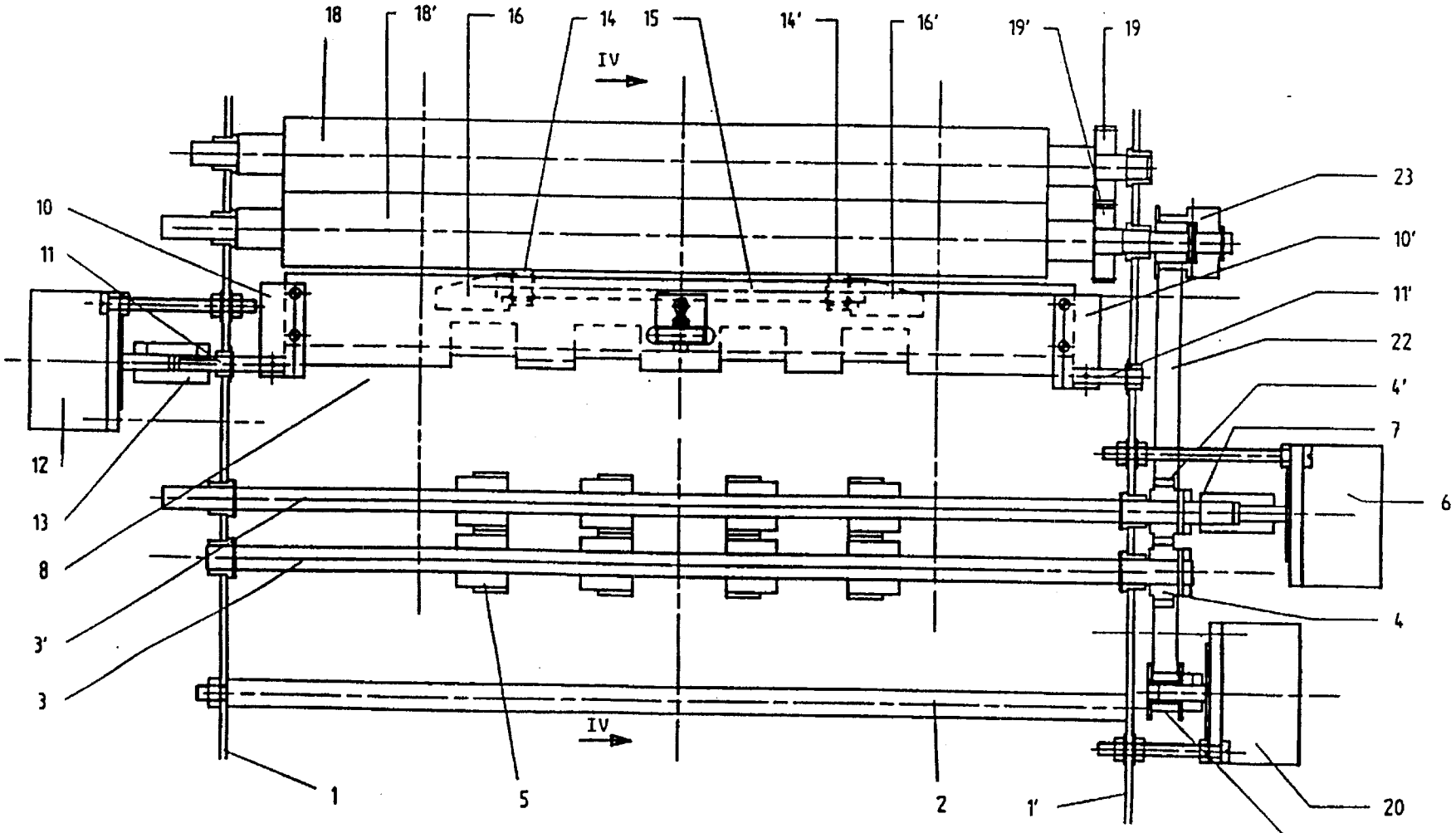
FIG. 1 is a developed sectional view of a folding machine employing a flap according to the present invention.
Figure 2:
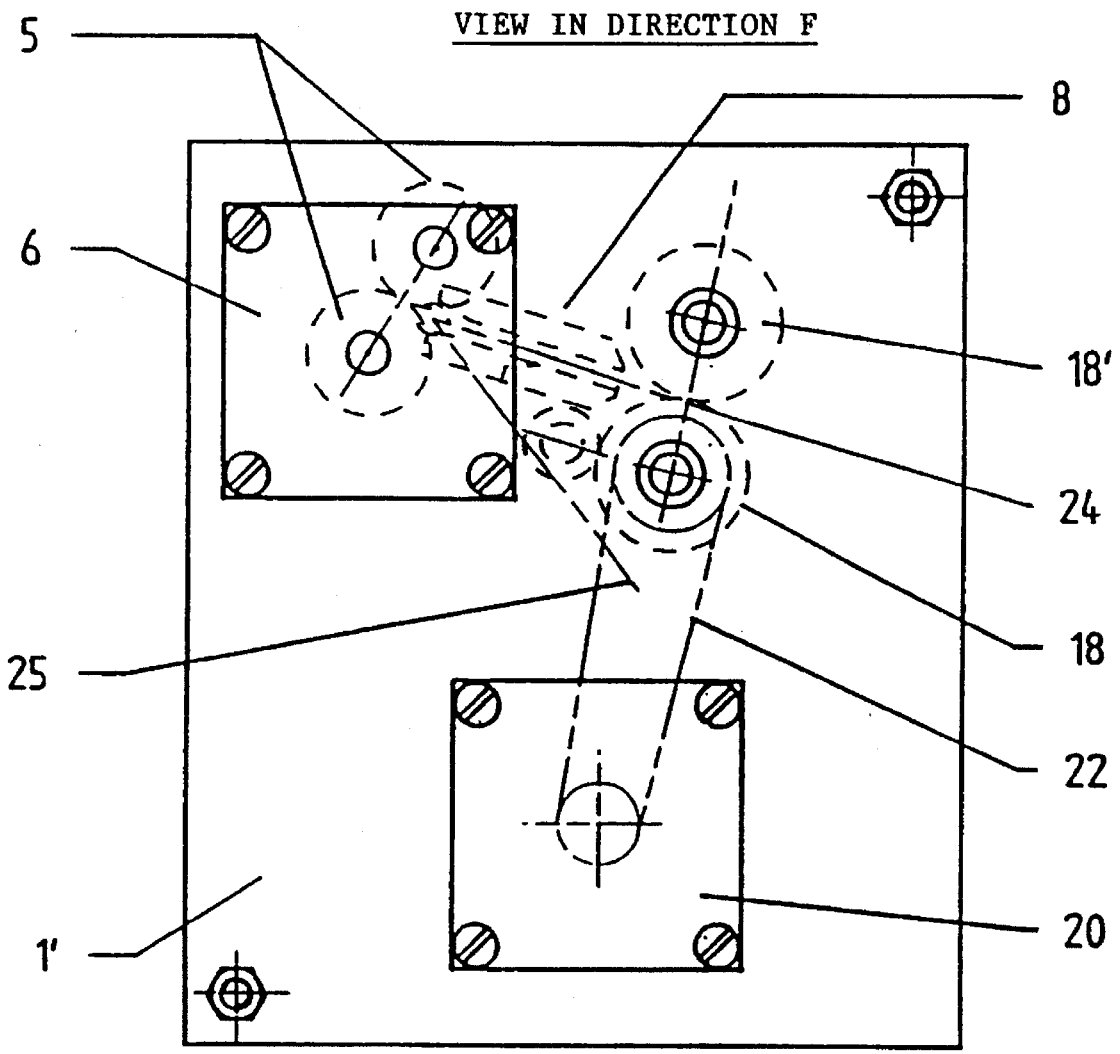
FIGS. 2, 3, 4 show side views according to the views F–F1 and IV—IV of FIG. 1.
Figure 3:
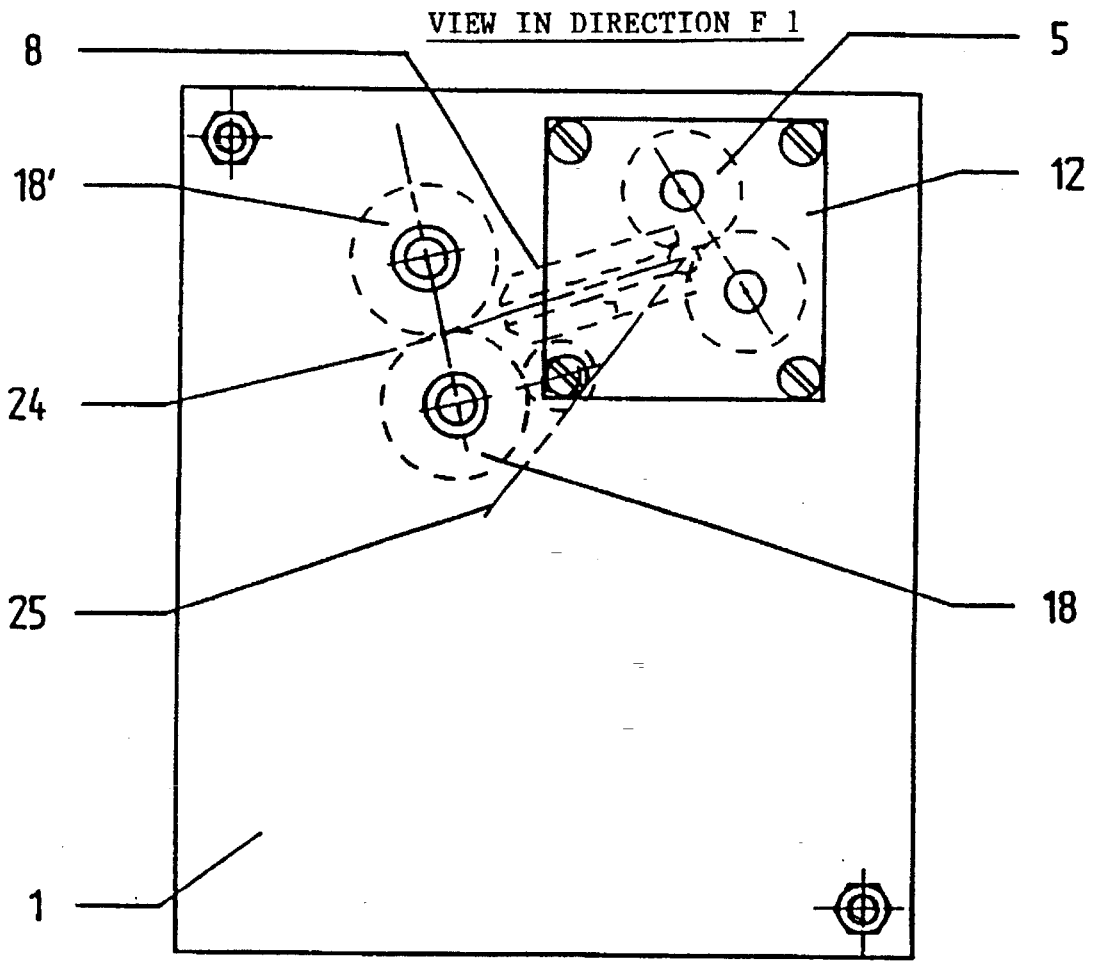
Figure 4:
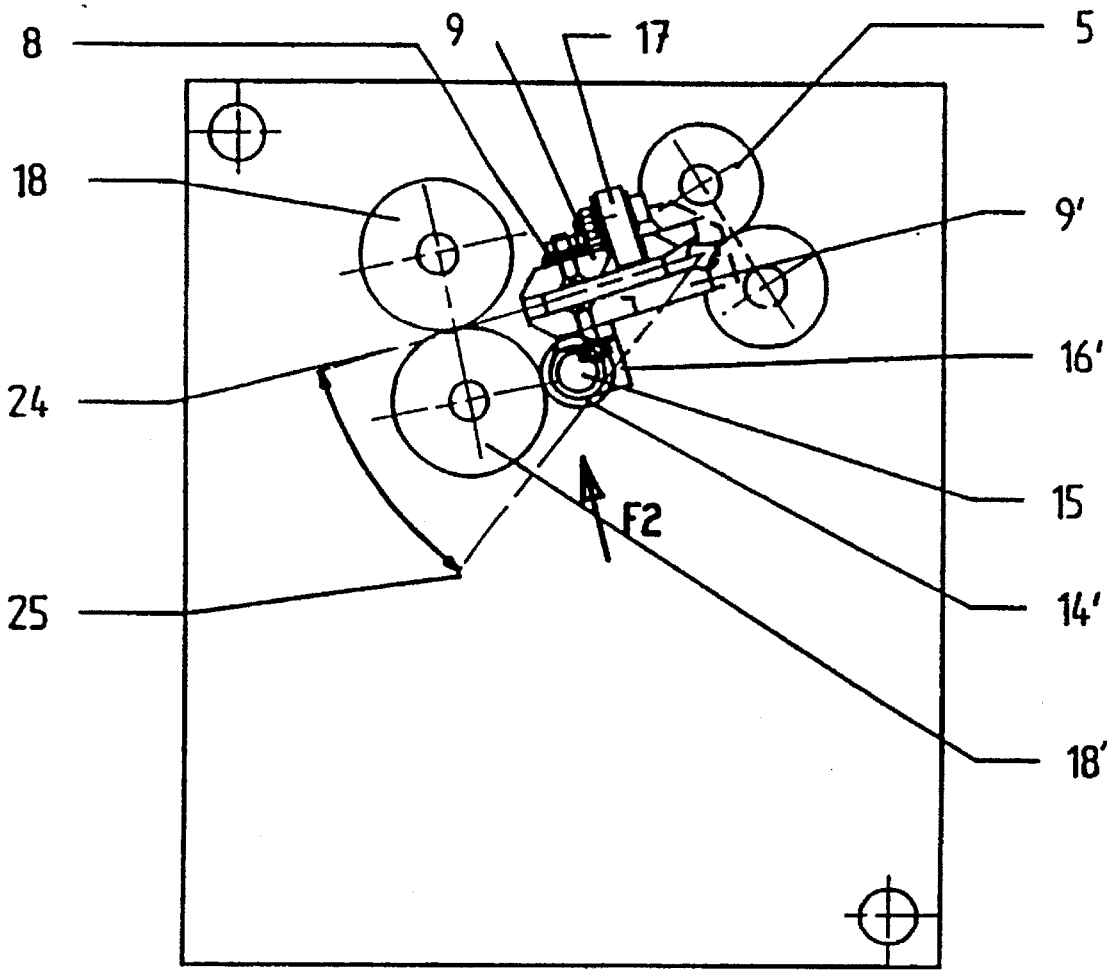

The folding machine employing a flap comprises a main structure formed by plates 1 and 1' and spacer members 2. This box structure provides a means to mount and guide various elements constituting the folding system.

The part feeding the document to be folded comprises two shafts 3 and 3' connected in rotation by two synchronization gears 4 and 4'. These two shafts, mounted on bearings, carry four pairs of tangent wheels 5. Said wheels are coated with a flexible and adherent rim. Said wheels are caused to rotate by the motor 6 of step-by-step type through a coupling sleeve 7.

The switching guide or flap 8 for orienting the document to be folded comprises two main plates 9 and 9' between which the document travels. They are rendered interconnected by the two lateral bracing plates 10 and 10'. Two journals 11 and 11' are screwed on the latter and permit the rotation of said switching flap 8. The rotation of this assembly is due to the effect of the motor 12 mounted at the end of the shaft 11 by the coupling sleeve 13. Clearance notches are provided in the plates 9 and 9' so as to avoid any collision with the document feeding wheels 5 upon the rotation of the flap 8. Two coated wheels 14 and 14', freely rotatable, are mounted on the shaft 15. This shaft, parallel to the axis of rotation of the flap 8, is connected to the plate 9' by brackets 16 and 16'. A reflection cell 17 is fixed on the plate 9 for monitoring the passage of the paper.

The folding unit, mounted on the output side of the switching flap 8 is constituted by two tangent rollers 18 and 18' provided with a flexible and adherent rim. These two rollers are synchronized in rotation by two gears 19 and 19'. The folding rollers are put into rotation by the dc motor-speed reducer unit 20 through the assembly comprising pulleys-toothed belt 21, 22, 23.

The different steps required to obtain a folding in three of a document are shown in succession in the FIGS. numbered 5 to 9.

Figure 5:
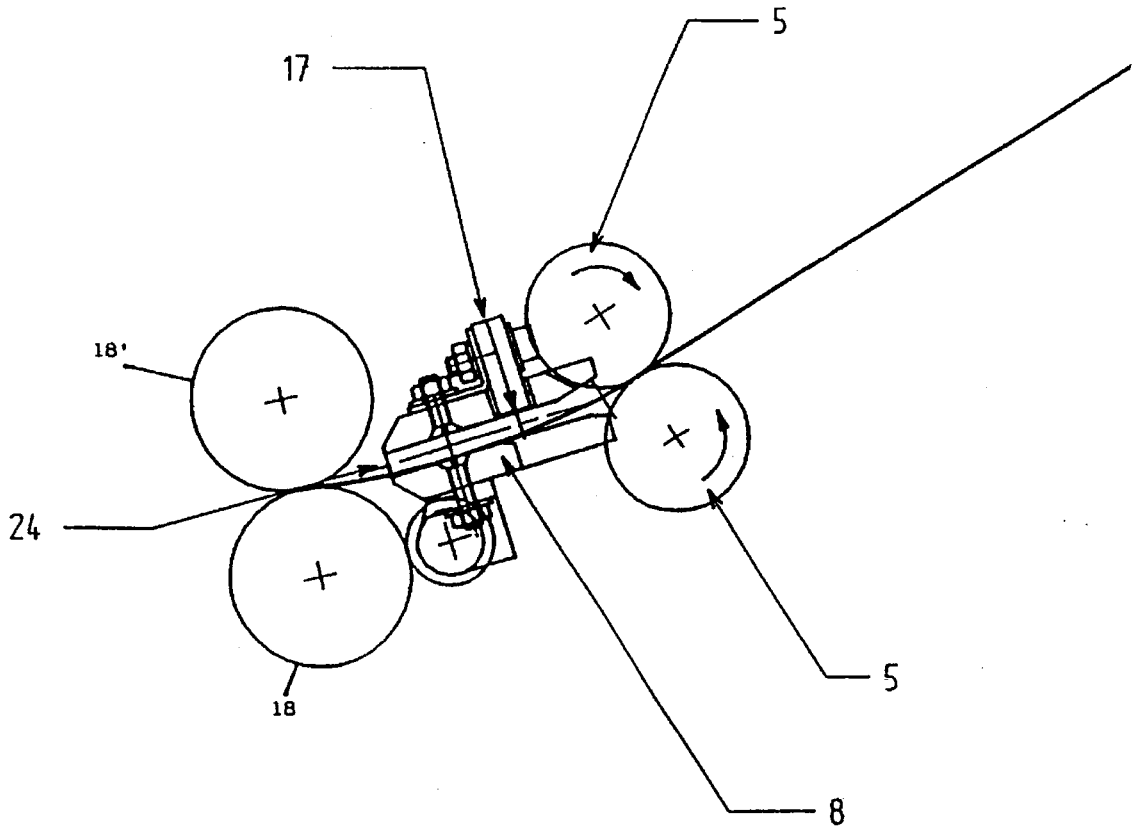
FIGS. 5, 6, 7, 8, 9 show side views in the course of the different steps of folding in three.

In FIG. 5, the switching flap 8 is in the upper position 24. The document feeding wheels 5 are started up. The document is first of all conveyed by a device located on the input side of the folding system and is not part of the invention. Said document is then taken up by the wheels 5 and then introduced in the switching flap 8. The microprocessor managing the movement of the document by means of the step-by-step motor 6 then receives the information of the passage of the front edge of the document in front of the reflection cell 17. Subsequent to this event, said microprocessor drives the motor 6 so that the document arrives at a position against the pair of rollers 18 and 18'.

Figure 6:
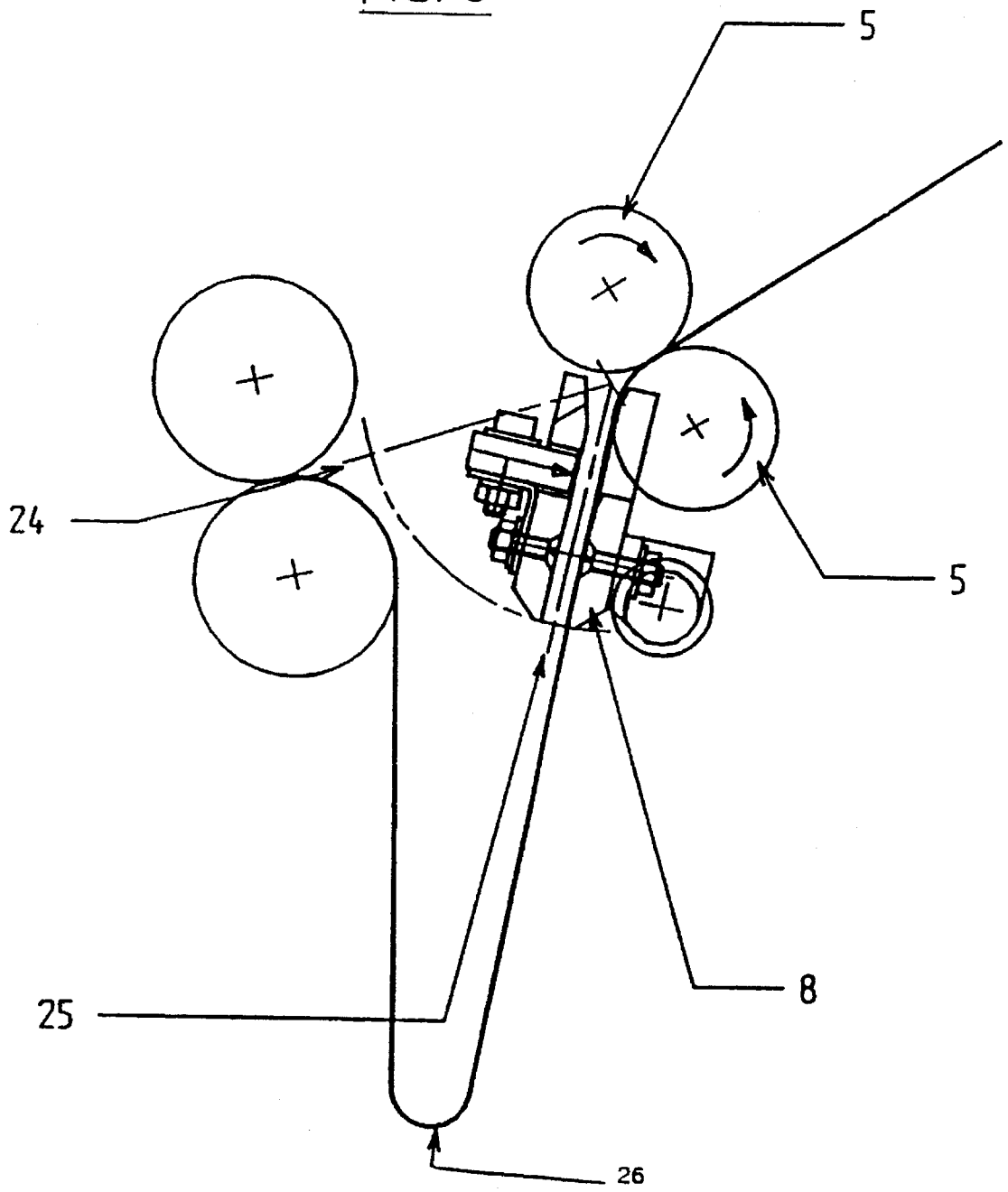

FIG. 6 shows the following step. The switching flap 8 is then swung by the motor 7 from the upper position 24 to a lower position 25. Right at the start of this rotation, the document feeding wheels 5 are started up. The document then forms the loop 26. It is by acting on the length of this loop, and therefore on the number of steps effected by the feeding rollers subsequent to their starting up that the length of the folds is varied. When the amount of document to be unwound is reached, the control system stops the rotation of the motor 6 and therefore of the wheels 5.

Figure 7:
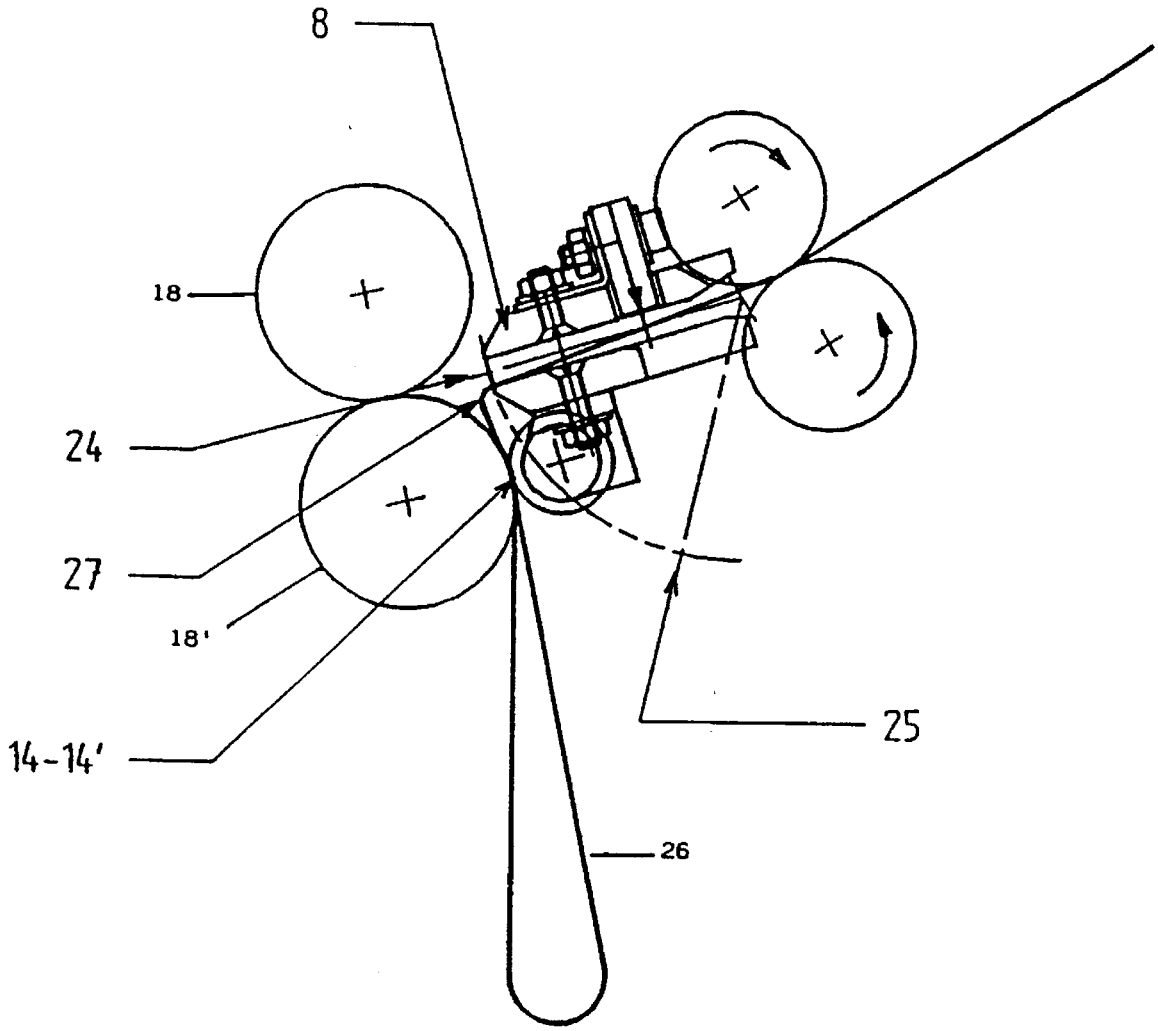

FIG. 7 shows the following step. The switching flap 8 is then swung by the motor 7 from the lower position 25 to an upper position 24. The wheels 14 and 14' then come to apply the loop of the document against the roller 18'. The document feeding wheels 5 are then started up. This has the effect of forming a small loop 27.

Figure 8:
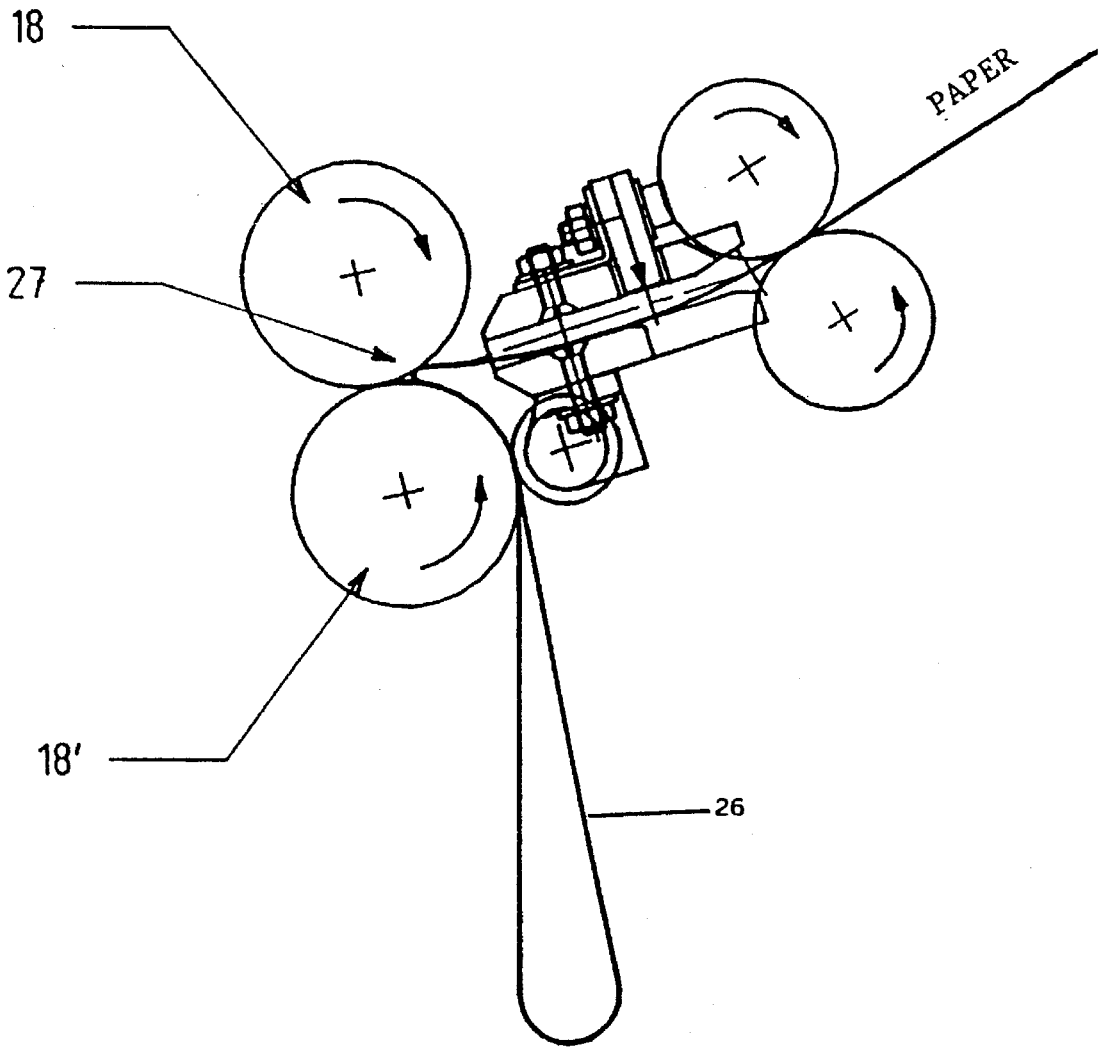

FIG. 8 shows the following step. The motor 6 moves through the number of steps which guarantees the good pressing of the loop 27 between the folding rollers 18 and 18'. The microprocessor then causes the rotation of the rollers 18 and 18' by means of the motor 25. The loop 27 is in this way rolled between the pair of rollers 18 and 18'.

Figure 9:
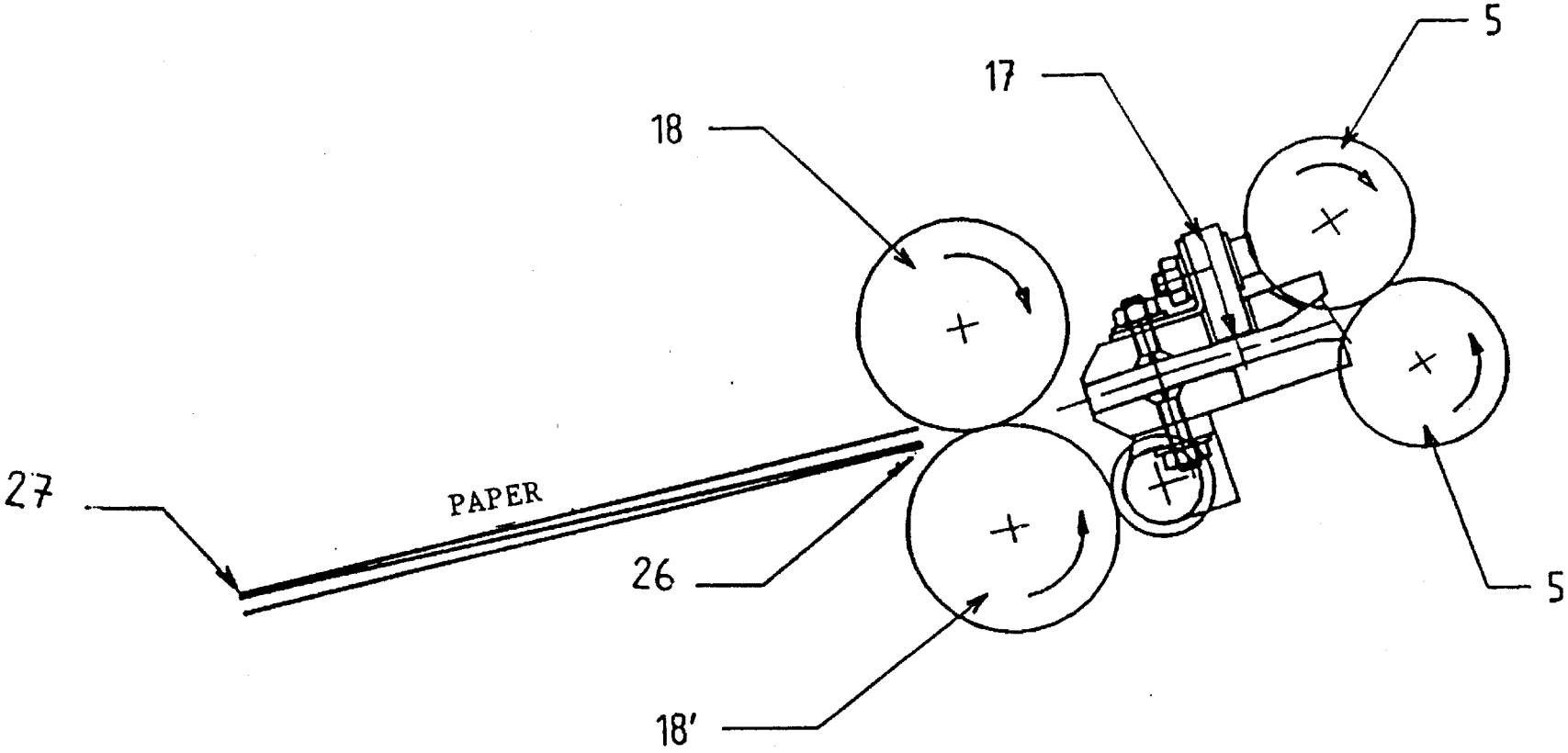

FIG. 9 shows the following step. As the rollers 18 and 18' pursue their rotation they then roll the loop 26 and then eject the document folded in three toward a receptacle which is located on the output side of the folding system and is not part of the invention. The reflection cell 17 informs the microprocessor of the passage of the rear edge of the document. After a period guaranteeing the complete ejection of the folded document the microprocessor stops the rotation of the rollers 18 and 18' and 5.

The different steps required to obtain a folding of a document in two are shown in succession in the FIGS. numbered 10 to 14.

Figure 10:
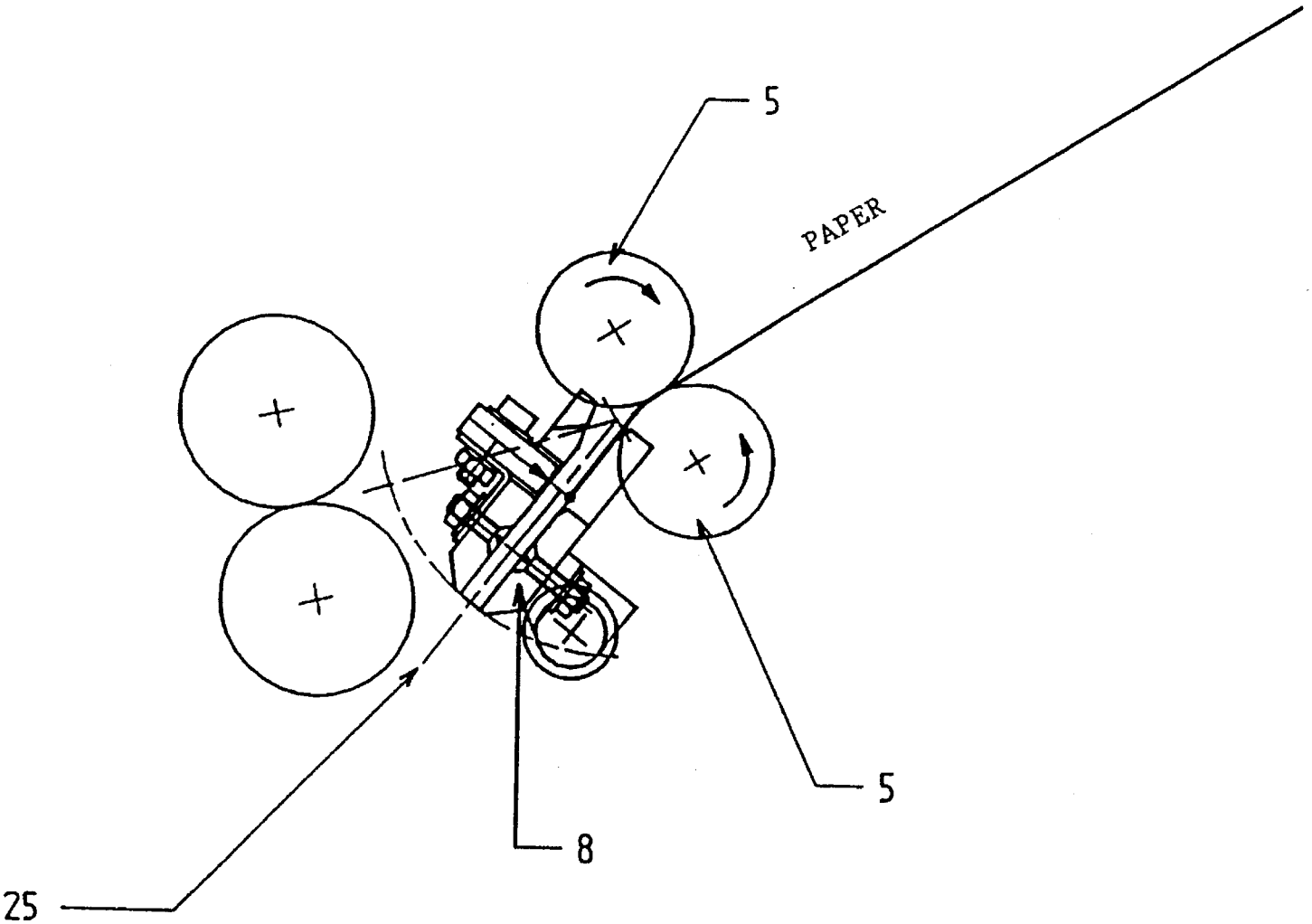
FIGS. 10, 11, 12, 13, 14 show side views in the course of the different steps of folding in two.

In FIG. 10, the switching flap 8 is in the lower position 25. The document feeding wheels 5 are started up. The document is first of all conveyed by a device which is located on the input side of the folding system and is not part of the invention. Said document is then taken up by the wheels 5 and then introduced in the switching flap 8.

Figure 11:
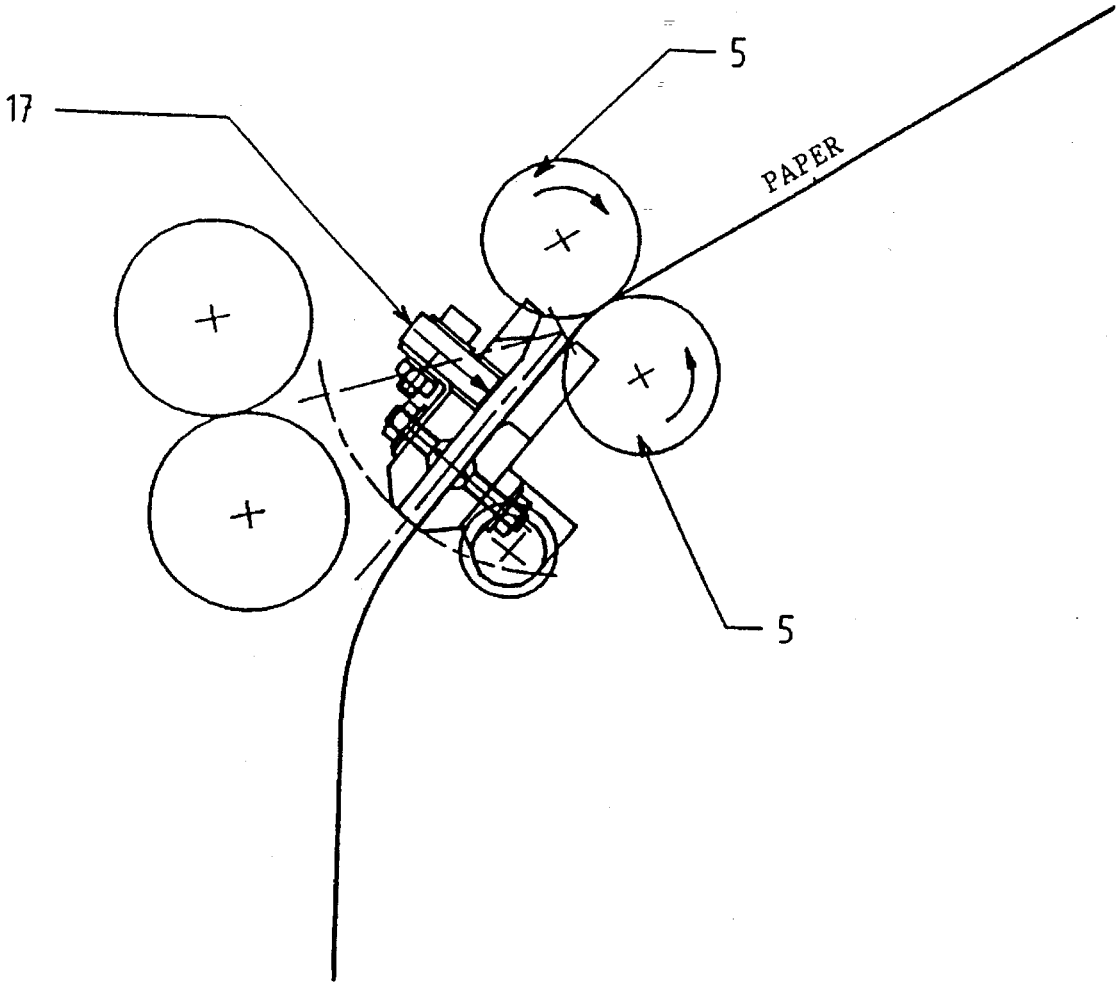

In FIG. 11, the microprocessor managing the movement of the document by means of the step-by-step motor 6 then receives the information of the passage of the front edge of the document in front of the reflection cell 17. Subsequent to this event, said microprocessor drives the motor 6 so that the wheels 5 unroll the required length of document. It is indeed this length of unrolled document which determines the length of the folds.

Figure 12:
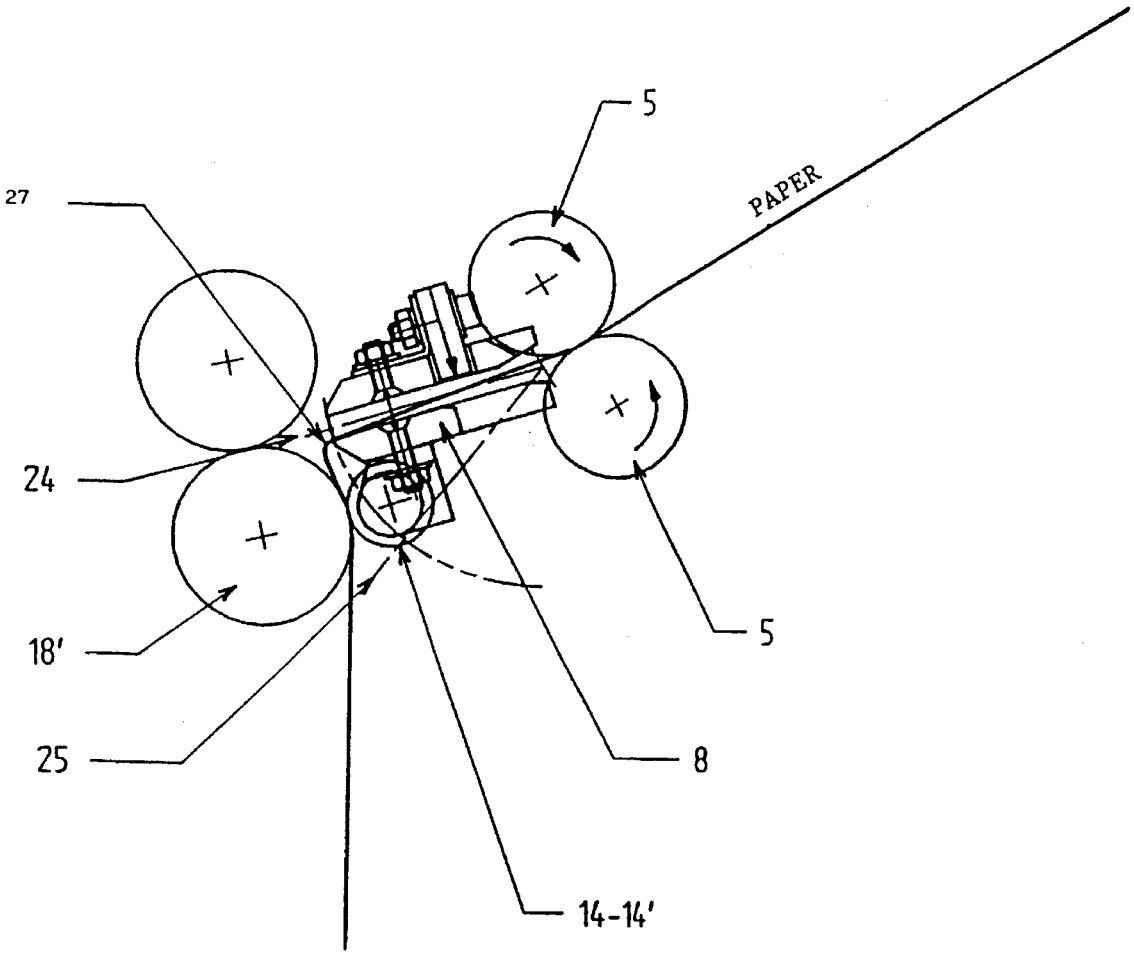

FIG. 12 shows the following step. The switching flap 8 is then swung by the motor 7 from the lower position 25 to an upper position 24. The wheels 14 and 14' then come to apply the document against the roller 18'. The document feeding wheels 5 are then started up. This has for effect to form a small loop 27.

Figure 13:
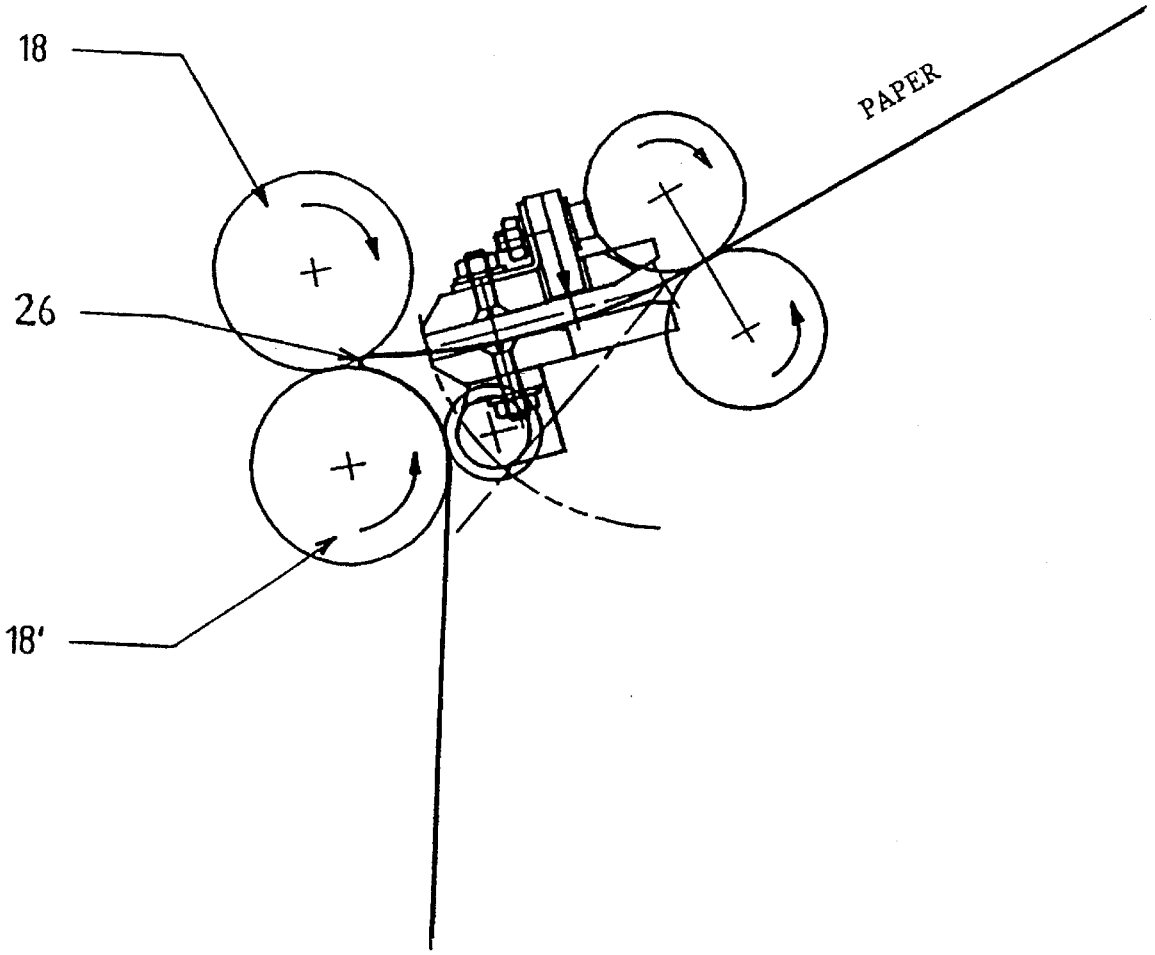

FIG. 13 shows the following step. The motor 6 effects the number of steps guaranteeing a good pressing of the loop 26 between the folding rollers 18 and 18'. The microprocessor then causes the rotation of 18 and 18' by means of the motor 13. The loop 27 is in this way rolled between the couple of rollers 18 and 18'.

Figure 14:
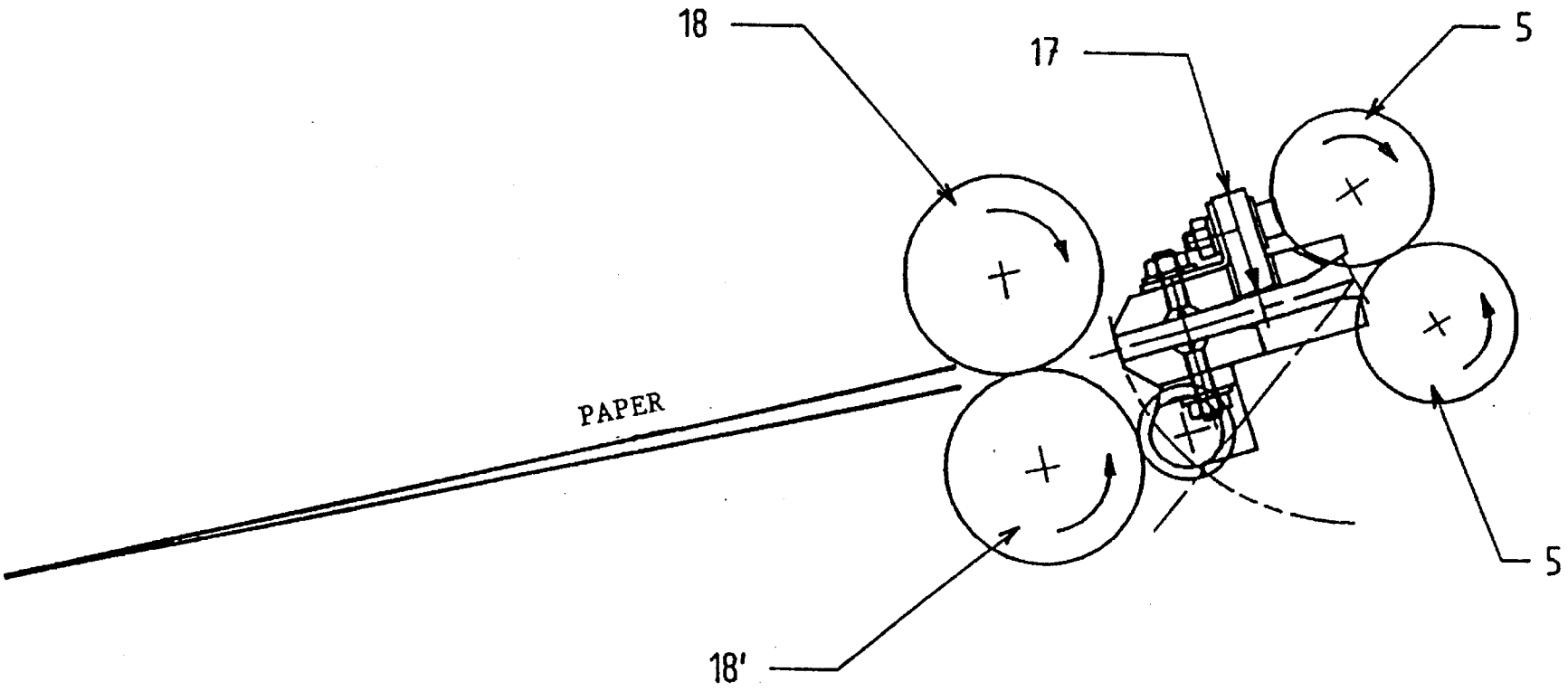

FIG. 14 shows the end step: the rollers 18 and 18' pursue their rotation and then eject the document folded in two toward a receptacle which is located on the output side of the folding system and is not part of the invention. The reflection cell 17 informs the microprocessor of the passage of the rear edge of the document. After a period of time guaranteeing the complete ejection of the folded document, the microprocessor stops the rotation of the rollers 18, 18' and 5.

We claim:

1. A sheet folding apparatus comprising:

a pair of input rollers forming a nip therebetween through which a sheet of paper is fed;

a first control means operatively coupled to the input rollers for controlling the movement thereof;

a pair of output rollers forming a nip therebetween for discharging the sheet therethrough;

a second control means operatively coupled to the output rollers for controlling the movement thereof;

a paper guide pivotally mounted between the input rollers and output rollers, the paper guide including a press roller, the paper guide being pivotable between a first position wherein the press roller is engaged with an output roller forming a nip therebetween and a second position wherein the press roller is pivotably disengaged from the output roller.

2. A sheet folding apparatus as defined in claim 1, further comprising a means for detecting the passage of a front and rear edge of a document.

3. A sheet folding apparatus as defined in claim 2, wherein the detecting means comprises a paper detecting cell, said paper detecting cell being positioned on the paper guide.

4. A sheet folding apparatus as defined in claim 1, wherein the first and second control means comprises a microprocessor.

5. A method of folding a sheet of paper comprising the steps of:

providing a folding apparatus comprising a pair of input rollers for feeding the sheet therethrough, a pair of output rollers for discharging the sheet therethrough, means for controlling the movement of said input and output rollers, and a paper guide having a press roller, the paper guide being pivotably mounted between the input and output rollers, the paper guide being pivotable between a first position wherein the press roller is engaged with an output roller forming a nip therebetween and a second position wherein the press roller is pivotably disengaged from the output roller;

driving the input rollers to feed a sheet through the paper guide in the second position until the sheet has been advanced a first predetermined length;

pivoting the paper guide to the first position;

driving the input rollers to advance the sheet a second predetermined distance to form a loop between the paper guide and output rollers;

driving the input rollers, press roller and output rollers so that the output rollers seize an initial portion of the loop; and feeding the sheet completely through the folding apparatus.

6. A method of folding a sheet of paper comprising the steps of:

providing a folding apparatus comprising a pair of input rollers for feeding the sheet therethrough, a pair of output rollers for discharging the sheet therethrough, means for controlling the movement of said input and output rollers, and a paper guide having a press roller, the paper guide being pivotably mounted between the input and output rollers, the paper guide being pivotable between a first position wherein the press roller is engaged with an output roller forming a nip therebetween and a second position wherein the press roller is pivotably disengaged from the output roller;

driving the input rollers to feed a sheet through the paper guide in the first position until the sheet contacts and is held between a nip formed by the output rollers;

pivoting the paper guide to the second position;

driving the input rollers to advance the sheet a first predetermined distance to form a first loop between the paper guide and output rollers;

pivoting the paper guide to the first position;

driving the input rollers to advance the sheet a second predetermined distance to form a second loop between the paper guide and output rollers;

driving the input rollers, press roller and output rollers so that the output rollers seize an initial portion of said second loop; and feeding the sheet completely through the folding apparatus.

* * * * *